US007075281B1

(12) United States Patent
Pettersen

(10) Patent No.: US 7,075,281 B1
(45) Date of Patent: Jul. 11, 2006

(54) PRECISION PTAT CURRENT SOURCE USING ONLY ONE EXTERNAL RESISTOR

(75) Inventor: Fred-Johan Pettersen, Oslo (NO)

(73) Assignee: Micrel, Inc., San Jose, CA (US)

( * ) Notice: Subject to any disclaimer, the term of this patent is extended or adjusted under 35 U.S.C. 154(b) by 0 days.

(21) Appl. No.: 11/205,231

(22) Filed: Aug. 15, 2005

(51) Int. Cl.
*G05F 3/04* (2006.01)

(52) U.S. Cl. ..... 323/312; 323/907

(58) Field of Classification Search ..... 323/312, 323/313, 314, 315, 316, 907; 327/538, 839
See application file for complete search history.

(56) References Cited

U.S. PATENT DOCUMENTS

| | | | | |
|---|---|---|---|---|
| 5,646,518 | A * | 7/1997 | Lakshmikumar et al. | 323/316 |
| 5,774,013 | A * | 6/1998 | Groe | 327/543 |
| 6,016,051 | A * | 1/2000 | Can | 323/315 |
| 6,642,699 | B1 * | 11/2003 | Gregoire, Jr. | 323/314 |
| 6,791,307 | B1 * | 9/2004 | Harrison | 323/312 |
| 6,885,179 | B1 * | 4/2005 | Ker et al. | 323/316 |

OTHER PUBLICATIONS

Smith et al., "The Current Conveyer—A New Circuit Building Block," Proceedings of the IEEE, Aug. 1968, pp. 1368-1369.

Sedra et al., "A Second-Generation Current Conveyor and Its Applications," IEEE Transactions on Circuit Theory, Feb. 1970, pp. 132 to 134.

* cited by examiner

*Primary Examiner*—Adolf Berhane
(74) *Attorney, Agent, or Firm*—Patent Law Group LLP; Carmen C. Cook

(57) ABSTRACT

A current source for providing a current proportional to absolute temperature (a PTAT current) with high precision is implemented using only one off-chip component. The current source utilizes a bandgap voltage, a voltage related to a current proportional to absolute temperature and a constant current to bias a pair of voltage controlled resistive devices. In operation, a known resistance is derived by applying a constant voltage across and a constant current through a first voltage controlled resistive device. A control voltage for maintaining the constant current through the first voltage controlled resistive device is applied to control the second voltage controlled resistive device, thereby generating the highly precise PTAT current at the second voltage controlled resistive device. In one embodiment, the current source uses only one off-chip resistor in a constant current source for generating the constant current.

16 Claims, 2 Drawing Sheets

PRECISION PTAT CURRENT SOURCE USING ONLY ONE EXTERNAL RESISTOR

FIELD OF THE INVENTION

The invention relates to a current source for generating a precise PTAT current and, in particular, to a current source for generating a precise PTAT current using only one external resistor.

DESCRIPTION OF THE RELATED ART

A current proportional to absolute temperature (PTAT) or a PTAT current is a current with a known temperature coefficient. PTAT currents are commonly used to bias transistors, amplifiers and other circuits when a PTAT current is desirable for compensating for performance variations due to temperature. Current sources for generating PTAT currents are known. One conventional method for generating a PTAT current is to mirror a PTAT current reference in a bandgap reference circuit. However, the PTAT current generated by such a PTAT current reference relies on integrated resistors formed on the integrated circuit of the bandgap reference circuit and such integrated resistors are notorious for being imprecise. Thus, when a PTAT current is generated from a bandgap reference circuit, the PTAT current suffers from imprecise absolute value due to inaccuracies of the resistance of the integrated resistors.

Other conventional PTAT current generation circuits use additional off-chip resistors to achieve high accuracy. Increasing off-chip component count increases the cost and also increases the space requirement for incorporating the PTAT current generation circuit on the printed circuit board (PCB).

A current source for generating a PTAT current having precise current value while using minimal off-chip components is desired.

SUMMARY OF THE INVENTION

According to one embodiment of the present invention, a current source circuit providing an output current being proportional to absolute temperature includes a first transistor and a first resistor connected in series between a positive power supply voltage and a ground voltage. The first transistor has a control terminal coupled to a first voltage related to a current proportional to absolute temperature to cause a current proportional to absolute temperature to flow through the first transistor and the first resistor. A second voltage being a voltage proportional to absolute temperature is developed at a first node between the first transistor and the first resistor.

The current source circuit further includes a first voltage-current buffering circuit having a first terminal coupled to receive the second voltage, a second terminal providing a third voltage being a buffered voltage of the second voltage, and a third terminal providing the output current proportional to absolute temperature where the output current is equal to a current flowing in the first terminal. The current source circuit includes a first voltage controlled resistive device having a first terminal coupled to the second terminal of the first voltage-current buffering circuit, a second terminal coupled to the ground voltage and a voltage control terminal receiving a control voltage.

The current source circuit further includes a constant voltage circuit receiving a bandgap voltage as an input voltage at an input terminal. The constant voltage circuit includes an output stage providing a fourth voltage being a buffered voltage of a fifth voltage related to the bandgap voltage at a first output terminal and providing a second output current at a second output terminal. The current source circuit includes a second voltage controlled resistive device having a first terminal coupled to the first output terminal of the constant voltage circuit, a second terminal coupled to the ground voltage and a voltage control terminal receiving the control voltage. The second voltage controlled resistive device matches the first voltage controlled resistive device.

Furthermore, the constant current circuit includes a first current mirror mirroring the second output current of the constant voltage circuit and supplying the mirrored current to a second resistor, a third resistor matching the second resistor and being supplied by a first constant current, and a comparator receiving a voltage across the second resistor and a voltage across the third resistor. The comparator generates the control voltage for controlling the resistance of the first and second voltage controlled resistive devices. The control voltage is generated to force the voltage across the second resistor to equal to the voltage across the third resistor.

A method for generating a current proportional to absolute temperature includes generating a first voltage proportional to absolute temperature on a first node, buffering the first voltage to generate a second voltage on a second node, coupling a first voltage controlled resistive device to the second node where the resistance value of the first voltage controlled resistive device is controlled by a control voltage and where a current flowing through the second node is the current proportional to absolute temperature, generating a third voltage at a third node from a bandgap voltage where the third voltage has a constant voltage value, coupling a second voltage controlled resistive device to the third node where the resistance value of the second voltage controlled resistive device is controlled by the control voltage and the second voltage controlled resistive device matches the first voltage controlled resistive device, mirroring a current flowing through the second voltage controlled resistive device to flow through a first resistor, flowing a constant current through a second resistor where the first resistor and the second resistor are matching resistive devices, and comparing a voltage across the first resistor and a voltage across the second resistor to generate the control voltage.

The present invention is better understood upon consideration of the detailed description below and the accompanying drawings.

DETAILED DESCRIPTION OF THE PREFERRED EMBODIMENTS

In accordance with the principles of the present invention, a current source for providing a current proportional to absolute temperature (a PTAT current) with high precision is implemented using only one external or off-chip component. The current source utilizes a bandgap voltage reference and a constant current source to bias a pair of voltage controlled resistors. In this manner, a precise PTAT current relatively insensitive to fabrication process variations is generated while the current source uses only one off-chip resistor in the constant current source circuit.

Figure 1:
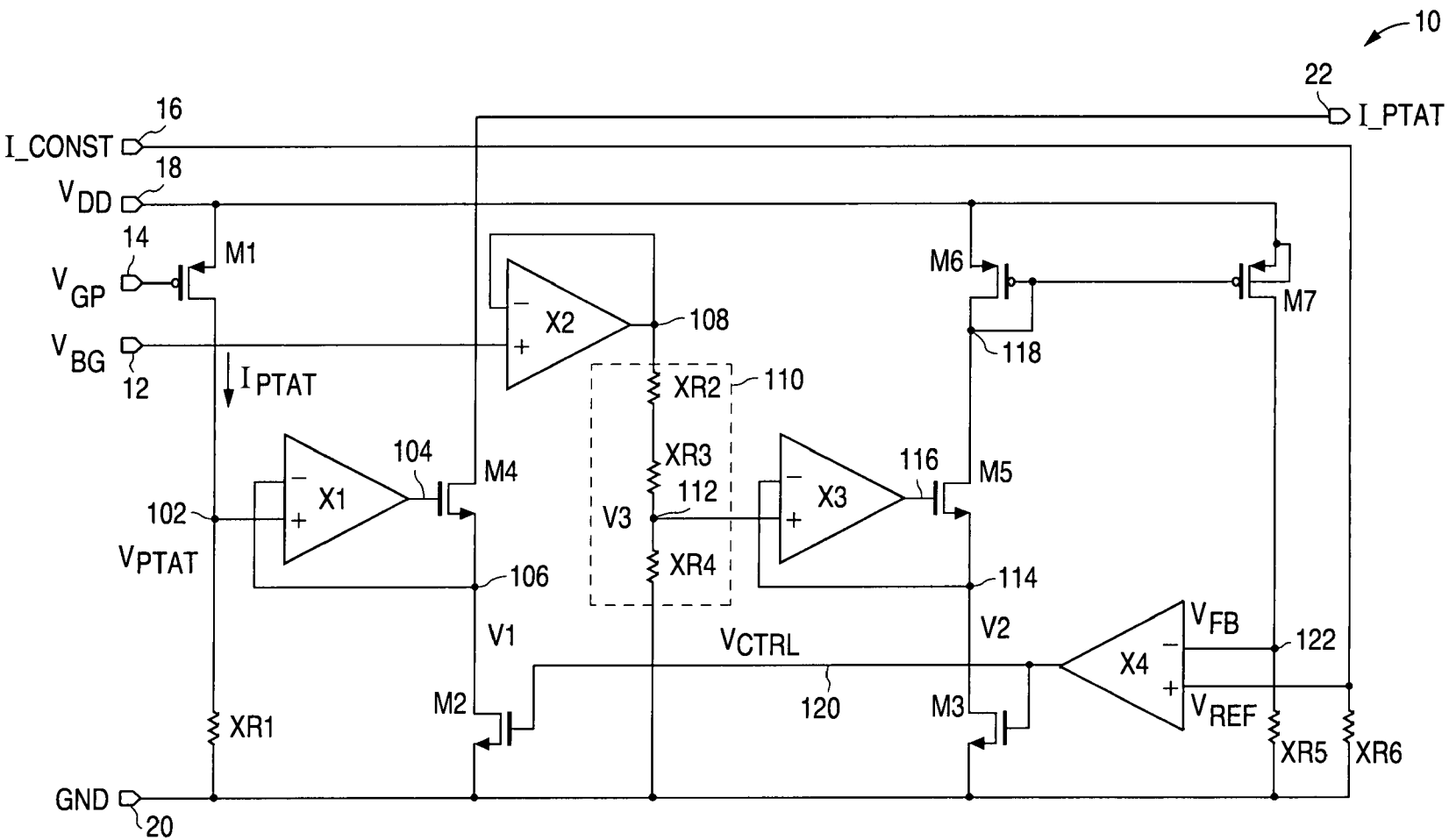
FIG. 1 is a circuit diagram of a current source for generating a PTAT current according to one embodiment of the present invention.

FIG. 1 is a circuit diagram of a current source for generating a PTAT current according to one embodiment of the present invention. Referring to FIG. 1, a current source 10 for generating a PTAT current I_PTAT (node 22) uses a bandgap voltage $V_{BG}$ (node 12) and a PTAT current reference $V_{GP}$ (node 14) from a bandgap reference circuit (not shown) and a constant current I_CONST (node 16) from a constant current source (not shown) to bias a pair of voltage controlled resistors implemented as NMOS transistors M2 and M3. When PTAT current source 10 is formed in an integrated circuit, implementation of PTAT current source 10 requires only one off-chip resistor external to the integrated circuit. PTAT current source 10 is capable of generating a highly precise PTAT current with only one external component.

In the present description, an "on-chip" device refers to a device that is integrated on the same integrated circuit as the PTAT current source while an "off-chip" device or an "external" component refers to a device or a component that is electrically connected to the PTAT current source but is not formed on the same integrated circuit as the PTAT current source.

The bandgap reference circuit in PTAT current source 10 can be constructed using any bandgap reference circuits known or to be developed, provided that the bandgap reference circuit can deliver a voltage necessary to generate a PTAT current as described by Eq. (1) below. The constant current source can be formed by applying the bandgap voltage to an off-chip resistor to generate one or more constant currents. In general, the off-chip resistor is a resistor with low tolerance on the absolute resistance value.

Figure 2:
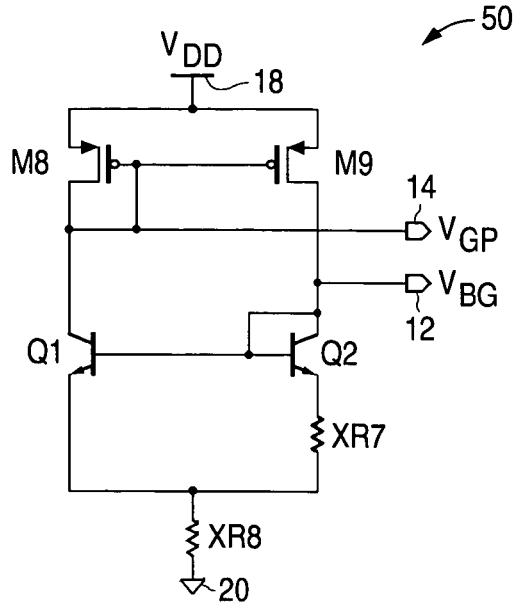
FIG. 2 is a circuit diagram of a bandgap reference circuit which can be incorporated in the current source of FIG. 1 to provide the bandgap voltage and a PTAT current reference according to one embodiment of the present invention.

FIG. 2 is a circuit diagram of a bandgap reference circuit which can be incorporated in the current source of FIG. 1 to provide the bandgap voltage and a PTAT current reference according to one embodiment of the present invention. A bandgap reference is a voltage reference that is stable and substantially constant over temperature and power supply variations. In general, a bandgap reference circuit generates a bandgap voltage of approximately 1.2 volts by developing a first voltage related to a multiple of the base-to-emitter voltage differential ($\Delta V_{BE}$) of a pair of transistors operating at different current densities and a second voltage related to the base-to-emitter voltage $V_{BE}$ of a third transistor. The first voltage $\Delta V_{BE}$ is proportional to absolute temperature (PTAT) and thus has a positive temperature coefficient. On the other hand, the second voltage $V_{BE}$ has a negative temperature coefficient. Thus, the sum of $K*\Delta V_{BE}$ (where K is a multiple) and the base-to-emitter voltage $V_{BE}$ produces a voltage that has nearly no temperature dependence and no power-supply dependence. The voltage sum is the bandgap voltage.

Referring to FIG. 2, bandgap reference circuit 50 includes an NPN transistor Q2 generating a base-to-emitter voltage $V_{BE}$ having a negative temperature coefficient. Bandgap reference circuit 50 further includes a differential amplifier formed by NPN transistors Q2 and Q1 generating a $\Delta V_{BE}$ voltage and PMOS transistors M8 and M9 forming a current mirror. Transistors M8 and M9 are coupled between the positive power supply voltage $V_{DD}$ (node 18) and the current output nodes. The sizes of transistors Q1 and Q2 are ratioed so as to create different current densities through each transistor. As a result, transistors Q2 and Q3 generate a $\Delta V_{BE}$ voltage which is developed across a resistor XR7. For example, the size ratio of transistor Q1 to transistor Q2 is 1:8. The $\Delta V_{BE}$ is added to voltage $V_{BE}$ to generate the bandgap voltage $V_{BG}$ at node 12. A resistor XR8 is coupled to the common node of the differential amplifier of transistors Q1 and Q2 (through resistor XR7) to provide tail current bias. In this manner, a reference voltage having near zero temperature coefficient is generated.

Bandgap reference circuit 50 can further be used to provide a PTAT current reference in the form of a voltage $V_{GP}$ on node 14. Specifically, the current flowing through transistors M8 and M9 is a PTAT current. Thus, by mirroring the current flowing through transistors M8 and M9 using gate voltage $V_{GP}$, a PTAT current reference can thus be derived from bandgap reference circuit 50. However, the PTAT current reference provided by bandgap reference circuit 50 is dependent on the absolute resistance value of the resistors in the bandgap reference circuit, in this case, resistor XR7. It is well known that the absolute resistance value of resistors formed in a silicon integrated circuit is very imprecise. Accordingly, the PTAT current reference provided by bandgap reference circuit 50 is also very imprecise.

The PTAT current flowing through transistors M8 and M9, denoted $I_{PTAT}$ in bandgap reference circuit 50 can be described as follows:

$$I_{PTAT} = Const_1 \cdot \frac{V_t}{R_{SQ}}, \qquad \text{Eq. (1)}$$

where $Const_1$ is a design parameter of the bandgap reference circuit, $V_t$ is a voltage proportional to absolute temperature and is given as $V_t$=kT/q, and $R_{SQ}$ is the absolute value of the resistance per square of resistor material for resistor XR7 in the bandgap reference circuit.

FIG. 2 illustrates an exemplary embodiment of a bandgap reference circuit which can be used to generate a bandgap voltage $V_{BG}$ and a PTAT current reference $V_{GP}$ for use by the PTAT current source of the present invention. One of ordinary skill in the art would appreciate that other bandgap reference circuits for generating a bandgap voltage and a PTAT current reference can be used in the PTAT current source of the present invention.

Figure 3:
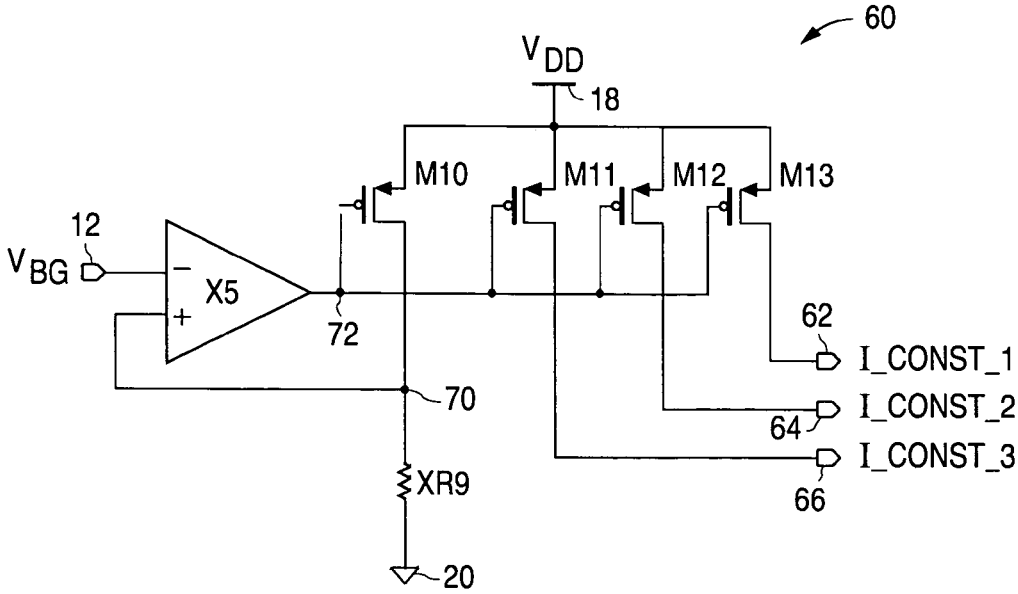
FIG. 3 is a circuit diagram of a constant current source which can be incorporated in the current source of FIG. 1 to provide a constant current according to one embodiment of the present invention.

FIG. 3 is a circuit diagram of a constant current source which can be incorporated in the current source of FIG. 1 to provide a constant current according to one embodiment of the present invention. Referring to FIG. 3, the constant current source 60 uses the bandgap voltage $V_{BG}$ (node 12) to generate one or more constant currents, such as currents I_CONST_1 to I_CONST_3 on nodes 62, 64 and 66, having current values that are substantially constant over temperature and power supply variations. Constant current source 60 includes an operational amplifier (op-amp) X5 receiving the bandgap voltage $V_{BG}$ on its negative input terminal. The positive input terminal of op-amp X5 (node 70) is connected to a resistor XR9 which is an off-chip resistor with low tolerance on absolute value. Off-chip resistor XR9 is connected between node 70 and ground node 20. The output terminal (node 72) of op-amp X5 is coupled to drive the gate terminals of a PMOS transistor M10 connected to resistor XR9 and one or more PMOS transistors M11 to M13. PMOS transistors M11 to M13 are used to provide a set of one or more constant currents.

When op-amp X5 is thus configured, the voltage at the positive input terminal is forced to the voltage value at the negative input terminal. Thus, the voltage across resistor XR9 is forced to be the same as the bandgap voltage $V_{BG}$. A constant current, established by applying a precise voltage across a precision resistor, flows through resistor XR9. The constant current being forced through resistor XR9 biases the gate-to-drain voltage of PMOS transistor M10. Because PMOS transistors M11 to M13 are biased by the same gate voltage as transistor M10, each of transistors M11 to M13 provides the same constant current as that of transistor M10. One or more constant currents I_CONST_1 to I_CONST_3 are therefore provided at the drain terminals (nodes 62, 64 and 66) of transistors M11 to M13. The source terminals of transistors M10 to M13 are connected to the positive power supply voltage $V_{DD}$ (node 18). In constant current source 60, PMOS transistors M10 to M13 are biased in saturation.

In the present illustration, constant current source 60 includes three PMOS transistors M11 to M13 to generate a set of three constant currents. One of ordinary skill in the art would appreciate that the number of PMOS transistors to use depends on the number of constant currents desired. For the purpose of the PTAT current source of the present invention, only one constant current is required and constant current source 60 can therefore be configured to include only one PMOS transistor M11 to provide one constant current I_CONST.

The construction of PTAT current source 10 for generating a precise PTAT current will now be described. Returning to FIG. 1, PTAT current source 10 makes a copy of the PTAT current reference generated in the bandgap reference circuit by using voltage $V_{GP}$. Specifically, a copy of the PTAT current $I_{PTAT}$ in bandgap reference circuit 50 of FIG. 2 is generated by coupling voltage $V_{GP}$ to drive the gate terminal of a PMOS transistor M1. As thus configured, PMOS transistors M1 and M8 form a current mirror and the drain current provided by transistor M1 at node 102 is the same current $I_{PTAT}$ as the current flowing through transistors M8 and M9 in the bandgap reference circuit. Current $I_{PTAT}$ is given by Equation (1) above.

Current $I_{PTAT}$ generated by transistor M1 is fed through a resistor XR1 which is connected between the drain terminal of transistor M1 and the ground voltage (node 20). A voltage $V_{PTAT}$ develops at node 102 as a result of current $I_{PTAT}$ flowing through resistor XR1. Resistor XR1 is matched to resistor XR7 of bandgap reference circuit 50 (FIG. 2). Thus, the voltage $V_{PTAT}$ on node 102 can be described as follows:

$$V_{PTAT} = Const_1 \cdot \frac{V_t}{R_{SQ}} \cdot Const_2 \cdot R_{SQ}, \quad \text{Eq. (2)}$$

where $Const_2$ is a design parameter of current source 10. Equation (2) simplifies to:

$$V_{PTAT} = Const_1 \cdot Const_2 \cdot V_t. \quad \text{Eq. (3)}$$

Voltage $V_{PTAT}$ on node 102 is buffered by operational amplifier X1 and an NMOS transistor M4. Specifically, voltage $V_{PTAT}$ is coupled to the positive input terminal of op-amp X1. The output terminal of op-amp X1 (node 104) is coupled to drive the gate terminal of transistor M4. The source terminal (node 106) of transistor M4 is coupled back to the negative input terminal of op-amp X1. The drain terminal of transistor M4 is the current source output terminal (node 22) providing the PTAT current I_PTAT. In particular, transistor M4 and another NMOS transistor M2 are connected in series between the current source output terminal (node 22) and the ground voltage (node 20). As thus configured, a voltage V1 develops at the common node between transistors M2 and M4 (node 106) which is also the voltage coupled back to the negative input terminal of op-amp X1. The current flowing through the source terminal (node 106) of transistor M4 is the same as the current flowing in the drain terminal (node 22) of transistor M4 providing the PTAT current I_PTAT. The operation of op-amp X1 and transistor M4 forces voltage V1 on node 106 to be equal to voltage $V_{PTAT}$ on node 102. Voltage V1 is thus a buffered version of voltage $V_{PTAT}$. Operational amplifier X1 and transistor M4 form a voltage-current buffering circuit for forcing a certain current at node 22 and a certain voltage at node 106. The operation of a voltage-current buffering circuit will be described in more detail below.

In operation, if the buffered voltage $V_{PTAT}$ (voltage V1) on node 106 is seeing a known and precise resistance to the ground node 20, the current flowing through transistor M4 would be a known and precise PTAT current and the PTAT current would be independent of the absolute value of resistor XR7 in bandgap reference circuit 50 (FIG. 2). A PTAT current that is independent of process variations can thus be derived. Thus, current source 10 of the present invention incorporates control circuitry for controlling the gate voltage of transistor M2 so that transistor M2 appears as a known and precise resistor connected between voltage V1 (node 106) and the ground voltage (node 20).

In current source 10, an NMOS transistor M3 identical to transistor M2 is used to establish the desired gate voltage for transistor M2. In operation, NMOS transistors M2 and M3 are biased in the linear region and the transistors act as voltage controlled resistors. Specifically, the gate terminals (node 120) of transistors M2 and M3 are driven by a control voltage $V_{CTRL}$ operative to bias the transistors in the linear region to provide a known and precise resistance. The generation of control voltage $V_{CTRL}$ is as follows.

First, the bandgap voltage $V_{BG}$ on node 12 is coupled to the positive input terminal of an operational amplifier X2 connected in a unity gain follower configuration. The voltage at the output terminal (node 108) of op-amp X2 is thus a buffered bandgap voltage $V_{BG}$. A voltage divider 110 including resistors XR2, XR3 and XR4 is used to divide down the buffered bandgap voltage $V_{BG}$. In the present embodiment, the buffered bandgap voltage $V_{BG}$ is divided by three and a voltage V3 at node 112 is one third of the bandgap voltage $V_{BG}$. In another embodiment, a different division factor can be used to divide down the bandgap voltage $V_{BG}$. The divided bandgap voltage V3 is further buffered by an operational amplifier X3 and an NMOS transistor M5. Specifically, the divided bandgap voltage V3 is coupled to the positive input terminal of op-amp X3 and the output terminal (node 116) of op-amp X3 is coupled to the gate terminal of transistor M5. The source terminal (node 114) of transistor M5 is connected back to the negative input terminal of op-amp X3. The voltage V2 at the source terminal (node 114) of transistor M5 is thus forced to be the same voltage as voltage V3 which is one third of the bandgap voltage $V_{BG}$. The current flowing in the drain terminal of transistor M5 (node 118) is the same as the current flowing in the source terminal (node 114) of transistor M5. Operational amplifier X3 and transistor M5 form a voltage-current buffering circuit for forcing a certain current at node 118 and a certain voltage at node 114. The operation of a voltage-current buffering circuit will be described in more detail below. Through the operation of op-amp X2, voltage divider 110, op-amp X3 and transistor M5, a known voltage V2 being $\frac{1}{3}V_{BG}$ is imposed across the drain and source terminal of transistor M3.

In sum, op-amp X2, voltage divider 110, op-amp X3 and transistor M5 form a constant voltage circuit for providing a constant voltage V2 at the drain terminal of transistor M3 (node 114). In the present embodiment, the constant voltage V2 is a divided voltage of the bandgap voltage $V_{BG}$. In other embodiment, the constant voltage V2 can be the bandgap voltage (without voltage division) or a divided voltage of any ratio.

If the voltage across the drain and source terminal of transistor M3 is forced to a known value, the resistance provided by transistor M3 will be known if the current flowing through the transistor M3 is also forced to a known value. In current source 10, the current flowing through transistor M3 is mirrored by a current mirror formed by PMOS transistors M6 and M7. PMOS transistors M6 and M7 have source terminals coupled to the power supply $V_{DD}$ voltage (node 18). The mirrored current is fed into a resistor XR5. Meanwhile, constant current I_CONST (node 16) generated by the constant current source 60 of FIG. 3 is fed into a resistor XR6. Resistors XR5 and XR6 are matching devices. Therefore, the voltages across resistors XR5 and XR6 will be identical if the currents flowing through the resistors are identical.

In current source 10, the voltage across resistor XR5 (at node 122) is denoted as a feedback voltage $V_{FB}$ while the voltage across resistor XR6 (at node 16) is denoted as a reference voltage $V_{REF}$. The feedback voltage $V_{FB}$ and the reference voltage $V_{REF}$ are coupled to the respective negative and positive input terminals of an operational amplifier X4. The output terminal (node 120) of op-amp X4 is the control voltage $V_{CTRL}$. If the currents through resistors XR5 and XR6 are not equal, voltages $V_{FB}$ and $V_{REF}$ are also not equal and op-amp X4 will vary the control voltage $V_{CTRL}$ to vary the resistance of transistors M2 and M3 until the current flowing through transistor M3, which is the same as the current flowing through resistor XR5, becomes identical to the current flowing through resistor XR6. As such, op-amp X4 operates as a comparator comparing voltage $V_{FB}$ and voltage $V_{REF}$ and forcing voltage $V_{FB}$ to equal to voltage $V_{REF}$. In essence, in the feedback network formed in current source 10, op-amp X4 functions as a summation-point for the feed-back network and operates to maintain the control voltage $V_{CTRL}$ at the desired level.

As a result of the control operation by op-amp X4, current source 10 generates a control voltage $V_{CTRL}$ to bias transistor M3 to generate a known resistance. The control voltage $V_{CTRL}$ is generated based on the bandgap voltage $V_{BG}$ and the constant current I_CONST. The resistance across transistor M3 and the resistance across transistor M2 are identical as the two transistors are matched and are biased by the same gate voltage. Specifically, the resistance of transistors M2 and M3 is given as follows:

$$R_{M2} = R_{M3} = \frac{V_{BG}/3}{\text{I_CONST}} = \frac{V_{BG}}{3 \cdot \text{I_CONST}} \quad \text{Eq. (4)}$$

The PTAT current I_PTAT flowing through transistor M2 is the drain current flowing through transistor M3. By combining Equations 3 and 4, we find the current flowing through transistor M2 to be given as follows:

$$\text{I_PTAT} = I_{D-M3} = \frac{Const_1 \cdot Const_2 \cdot V_t}{V_{BG}/3 \cdot \text{I_CONST}} \quad \text{Eq. (5)}$$

It can be observed from Equation (5) that the only variable in the equation is the voltage $V_t$ term. Thus, current I_PTAT has only a temperature dependent variation and is independent of process variations that may affect the accuracy of the resistance values in the current source circuit. As a result, current source 10 generates a precise PTAT current using only one external resistor (resistor XR9).

The current source of the present invention can be applied as a biasing source or the current source can be applied in a temperature measurement system. The current source of the present invention provides many advantages. First, the current source of the present invention generates a PTAT current with high accuracy while using only one external resistor. By reducing the external component count of the current source as compared to the conventional circuit, the current source of the present invention can realize cost reduction and PCB space reduction.

Another advantage of the current source of the present invention is that the PTAT current is highly precise and is insensitive to process variations. This is because the PTAT current does not rely on the accuracy of any on-chip resistor whose resistance is highly dependent on the fabrication process conditions.

Alternate Embodiments

The current source of the present invention may include power-down circuitry (not shown) for properly shutting down the current source. Power-down circuitry for a current source is well known in the art.

In current source 10 of FIG. 1, NMOS transistors M2 and M3 are biased in the linear region to act as a pair of voltage controlled resistors. In other embodiments, other voltage controlled resistive devices can be used in place of transistors M2 and M3. Furthermore, in current source 10 of FIG. 1, the operational amplifier X2 configured in a unity-gain follower configuration functions as a voltage buffer and can be replaced by any suitable high input impedance voltage buffer.

On the other hand, the operational amplifier-transistor circuit block formed by op-amp X1 and transistor M4 and op-amp X3 and transistor M5 is a voltage-current buffering circuit receiving an input voltage on a first terminal and providing an output voltage on a second terminal and an output current on a third terminal. The operational characteristics of the voltage-current buffering circuit are that the output voltage on the second terminal is the same as the input voltage on the first terminal and the output current flowing in the third terminal is the same as the current flowing in the second terminal. The currents at the second and third terminals can both flow into or out of the buffering circuit or the currents at the second and third terminals can flow in opposite directions, with one current flowing into and one current flowing out of the buffering circuit. It is instructive to note that the direction of the output current flow in a voltage-current buffering circuit is circuit specific and is selected based on circuit output requirements. The current directions used in the voltage-current buffering circuits in the current source of the present invention are illustrative only.

For example, in the voltage-current buffering circuit of op-amp X1 and transistor M4, the input voltage on the first terminal (node 102) is voltage $V_{PTAT}$ and the output voltage on the second terminal (node 106) is forced to equal to voltage $V_{PTAT}$. The current $I_{PTAT}$ flowing out of the third terminal (node 22) is the same as the current flowing into the second terminal (node 106). Op-amp X1 and transistor M5 form a voltage-current buffering circuit having the same operational characteristics as described above with the first terminal being node 112, the second terminal being node 114 and the third terminal being node 118. In other embodiments, other suitable voltage-current buffering circuits having the same operational characteristics described above can be used in place of the op-amp/transistor circuits formed by devices X1/M5 and devices X3/M5 in the present embodiment. For instance, a current conveyor type circuit can be used to implement the voltage-current buffering circuit in the current source of the present invention. Current conveyor circuits are described in Smith et al., "The Current Conveyer-A New Circuit Building Block," Proceedings of the IEEE, August 1968, pages 1368–1369; and Sedra et al., "A Second-Generation Current Conveyor and Its Applications," IEEE Transactions on Circuit Theory, February 1970, pages 132 to 134.

Furthermore, in the current source of FIG. 1, operational amplifier X3 and transistors M5, M6 and M7 can be taken collectively as a voltage-current buffering circuit as transistors M6 and M7 merely function as a current mirror to mirror the output current provided at the current output terminal of the voltage-current buffering circuit of op-amp X3 and transistor M5. Accordingly, a voltage-current buffering circuit formed by op-amp X3 and transistors M5, M6 and M7 has a first terminal at node 112 receiving voltage V3, a second terminal at node 114 providing a voltage V2 and a third terminal at node 112 providing a current flowing through resistor XR5. The voltage-current buffering circuit thus formed is of the type where the currents are both flowing into the second and third terminals. In other embodiments, voltage-current buffering circuits of other configurations can be used to implement the voltage-current buffering circuit formed by op-amp X3 and transistors M5, M6 and M7. For instance, a voltage-current buffering circuit with currents flowing out of the second and third terminals can be used.

The current source of FIG. 1 includes a divide-by-3 voltage divider 110 to divide down the bandgap voltage $V_{BG}$. A divided down bandgap voltage is applied across transistor M3 so that the transistor can be biased in the linear region. When transistor M3 is replaced by a voltage controlled resistive device, the voltage controlled resistance device may not have such voltage biasing requirement and the full bandgap voltage may be applied across the voltage controlled resistance device. That is, the voltage divider in current source 10 is optional and may be omitted in other embodiments.

As described above, when a voltage divider is used to divide down the bandgap voltage, any division ratio can be used. The use of a divide-by-3 voltage divider in FIG. 1 is illustrative only. Furthermore, voltage divider circuits are well known and the voltage divider in the current source of the present invention can be implemented using any voltage divider circuits. The resistor string voltage divider circuit used in FIG. 1 is illustrative only.

While resistors XR5 and XR6 in current source 10 are matching devices, they can be formed using any resistor material and the resistors do not have to be made of the same material as resistor XR1.

Other performance enhancement circuit elements such as cascodes may be used to enhance the performance of the circuit, as is well known in the art. Lastly, the bulk connections for the transistor devices can be connected in various ways to improve the performance of the current source.

The above detailed descriptions are provided to illustrate specific embodiments of the present invention and are not intended to be limiting. Numerous modifications and variations within the scope of the present invention are possible. The present invention is defined by the appended claims.

I claim:

1. A current source circuit providing an output current being proportional to absolute temperature, the circuit comprising:

a first transistor and a first resistor connected in series between a positive power supply voltage and a ground voltage, the first transistor having a control terminal coupled to a first voltage related to a current proportional to absolute temperature to cause a current proportional to absolute temperature to flow through the first transistor and the first resistor, a second voltage being a voltage proportional to absolute temperature being developed at a first node between the first transistor and the first resistor;

a first voltage-current buffering circuit having a first terminal coupled to receive the second voltage, a second terminal providing a third voltage being a buffered voltage of the second voltage, and a third terminal providing the output current proportional to absolute temperature, the output current being equal to a current flowing in the second terminal;

a first voltage controlled resistive device having a first terminal coupled to the second terminal of the first voltage-current buffering circuit, a second terminal coupled to the ground voltage and a voltage control terminal receiving a control voltage;

a constant voltage circuit receiving a bandgap voltage as an input voltage at an input terminal, the constant voltage circuit comprising an output stage providing a fourth voltage being a buffered voltage of a fifth voltage related to the bandgap voltage at a first output terminal and providing a second output current at a second output terminal;

a second voltage controlled resistive device having a first terminal coupled to the first output terminal of the constant voltage circuit, a second terminal coupled to the ground voltage and a voltage control terminal receiving the control voltage, the second voltage controlled resistive device matching the first voltage controlled resistive device;

a first current mirror mirroring the second output current of the constant voltage circuit and supplying the mirrored current to a second resistor;

a third resistor matching the second resistor and being supplied by a first constant current; and a comparator receiving a voltage across the second resistor and a voltage across the third resistor, the comparator generating the control voltage for controlling the resistance of the first and second voltage controlled resistive devices, the control voltage being generated to force the voltage across the second resistor to equal to the voltage across the third resistor.

2. The current source circuit of claim 1, further comprising:

a bandgap reference circuit providing the bandgap voltage and the first voltage related a current proportional to absolute temperature, the bandgap reference circuit comprising a second current mirror providing the current proportional to absolute temperature, the first voltage being a bias voltage of the current mirror.

3. The current source circuit of claim 2, wherein the first transistor comprises a PMOS transistor having a gate terminal coupled to the first voltage, a drain terminal coupled to the first node and a source terminal coupled to the positive power supply voltage, the first transistor forming a current mirror with the second current mirror of the bandgap reference circuit for mirroring the current proportional to absolute temperature using the first voltage.

4. The current source circuit of claim 2, further comprising:

a constant current source receiving the bandgap voltage from the bandgap reference circuit and generating the first constant current, the constant current source adapted to apply a buffered voltage of the bandgap voltage to a fourth resistor to cause a constant current to flow through the fourth resistor, the constant current source further comprising a current mirror for mirroring the constant current flowing through the fourth resistor as the first constant current.

5. The current source circuit of claim 4, wherein the fourth resistor is an off-chip resistor formed outside of the integrated circuit on which the current source circuit is formed.

6. The current source circuit of claim 1, wherein the first voltage-current buffering circuit comprises:

a first operational amplifier having a positive input terminal being the first terminal, a negative input terminal being the second terminal, and an output terminal providing a voltage indicative of the difference between the voltages at the positive input terminal and the negative input terminal; and a second transistor having a control terminal coupled to the output terminal of the first operational amplifier, a first current handling terminal being the second terminal providing the third voltage and a second current handling terminal being the third terminal providing the output current proportional to absolute temperature.

7. The current source circuit of claim 1, wherein:

the first voltage controlled resistive device comprises a third transistor having a control terminal coupled to the control voltage, a first current handling terminal coupled to the second terminal of the first voltage-current buffering circuit and a second current handling terminal coupled to the ground voltage; and the second voltage controlled resistive device comprises a fourth transistor having a control terminal coupled to the control voltage, a first current handling terminal coupled to the first output terminal of the constant voltage circuit and a second current handling terminal coupled to the ground voltage, wherein the third transistor and the fourth transistor are matching transistor devices.

8. The current source circuit of claim 1, wherein the constant voltage circuit comprises:

a second operational amplifier having a positive input terminal coupled to receive the bandgap voltage, a negative input terminal and an output terminal providing a sixth voltage being a buffered voltage of the bandgap voltage;

a third operational amplifier having a positive input terminal coupled to receive the fifth voltage derived from the sixth voltage, a negative input terminal being the second output node, and an output terminal providing a voltage indicative of the difference between the voltages at the positive input terminal and the negative input terminal; and a fifth transistor being the output stage, the fifth transistor having a control terminal coupled to the output terminal of the third operational amplifier, a first current handling terminal being the first output terminal providing the fourth voltage and a second current handling terminal being the second output terminal.

9. The current source circuit of claim 8, wherein the constant voltage circuit further comprises a voltage divider coupled between the output terminal of the second operational amplifier and the ground voltage, the voltage divider adapted to divide down the sixth voltage to generate the fifth voltage, the fifth voltage being a divided down voltage of the bandgap voltage.

10. The current source circuit of claim 9, wherein the fifth voltage is one third of the bandgap voltage.

11. The current source circuit of claim 1, wherein the comparator comprises a fourth operational amplifier having a positive input terminal coupled to receive the voltage across the third resistor, a negative input terminal coupled to receive the voltage across the second resistor and an output terminal providing the control voltage.

12. A method for generating a current proportional to absolute temperature, comprising:

generating a first voltage proportional to absolute temperature on a first node;

buffering the first voltage to generate a second voltage on a second node;

coupling a first voltage controlled resistive device to the second node, the resistance value of the first voltage controlled resistive device being controlled by a control voltage, wherein a current flowing through the second node is the current proportional to absolute temperature;

generating a third voltage at a third node from a bandgap voltage, the third voltage having a constant voltage value;

coupling a second voltage controlled resistive device to the third node, the resistance value of the second voltage controlled resistive device being controlled by the control voltage, the second voltage controlled resistive device matching the first voltage controlled resistive device;

mirroring a current flowing through the second voltage controlled resistive device to flow through a first resistor;

flowing a constant current through a second resistor, the first resistor and the second resistor being matching resistive devices; and comparing a voltage across the first resistor and a voltage across the second resistor to generate the control voltage.

13. The method of claim 12, further comprising:

generating the bandgap voltage using a bandgap reference circuit, the bandgap reference circuit including a fourth voltage related to a current proportional to absolute temperature;

coupling the fourth voltage to a current mirror to generate a first current that is proportional to absolute temperature; and flowing the first current through a third resistor to generate the first voltage.

14. The method of claim 12, wherein generating the third voltage at the third node from a bandgap voltage comprises:

buffering the bandgap voltage to generate a fifth voltage on a fourth node;

generating a sixth voltage derived from the fifth voltage; and buffering the sixth voltage to generate the third voltage at the third node.

15. The method of claim 14, wherein generating a sixth voltage derived from the fifth voltage comprises dividing down the fifth voltage to generate the sixth voltage.

16. The method of claim 15, wherein the sixth voltage is one third of the fifth voltage.

* * * * *